United States Patent [19]

Nakamura

[11] Patent Number: 4,622,726

[45] Date of Patent: Nov. 18, 1986

[54] RELEASABLE FASTENING CONSTRUCTION

[75] Inventor: Tatsuo Nakamura, Tokyo, Japan

[73] Assignee: TDK Corporation, Tokyo, Japan

[21] Appl. No.: 766,950

[22] Filed: Aug. 19, 1985

[30] Foreign Application Priority Data

Aug. 21, 1984 [JP] Japan ..... 59-126651[U]

[51] Int. Cl.[4] ..... A44B 13/00; A41F 5/08

[52] U.S. Cl. ..... 24/590; 24/599; 24/616; 24/663; 24/303

[58] Field of Search ..... 24/590, 599, 616, 618, 24/598, 588, 589, 242, 303, 49 M; 248/206.5

[56] References Cited

U.S. PATENT DOCUMENTS

| | | | |
|---|---|---|---|
| 921,846 | 5/1909 | Kerley | 24/616 |
| 926,602 | 6/1909 | Pollock | 24/616 |
| 1,177,509 | 3/1916 | Gilson | 24/242 |
| 1,347,515 | 7/1920 | Lutz | 24/663 |
| 1,540,030 | 6/1925 | Mestars | 24/242 |
| 1,807,293 | 5/1931 | Keller | 24/616 |
| 3,129,477 | 4/1964 | Mizuno | 24/303 |
| 3,141,216 | 7/1964 | Brett . | |
| 3,365,759 | 1/1968 | Molzan et al. | 24/599 |
| 3,984,900 | 10/1976 | Cirelli | 24/242 |
| 4,095,587 | 6/1978 | Ishikawa . | |
| 4,532,682 | 8/1985 | Murao | 24/616 |
| 4,566,159 | 1/1986 | Leroux | 24/599 |

FOREIGN PATENT DOCUMENTS

| | | | |
|---|---|---|---|
| 343348 | 11/1921 | Fed. Rep. of Germany | 24/590 |
| 413995 | 8/1910 | France | 24/590 |
| 258659 | 5/1949 | Switzerland | 24/590 |

*Primary Examiner*—Victor N. Sakran

[57] ABSTRACT

A releasable fastening construction for detachably fastening together both ends of an article such as personal ornaments which is capable of not only readily accomplishing the fastening and releasing operation but ensuring the positive and reliable fastening. The releasable fastening construction comprises a first connector having a blind hole defined therein and adapted to be connected to one end of an article, a second connector fitted in the blind hole of the first connector and adapted to be connected to the other end of the article, a projection provided on one of the connectors, a cut-out or groove of a substantially L-shape provided at the other of the connectors to permit the projection to be fitted therein when the second connector is fitted in the blind hole of the first connector and having a semi-circular recess provided at the terminal end thereof to hold the projection therein, and magnets respectively arranged at the closed end of the blind hole and at the inner end of the second connector in a manner to be opposite to each other when the second connector is fitted in the blind hole and so as to repel each other.

16 Claims, 12 Drawing Figures

RELEASABLE FASTENING CONSTRUCTION

BACKGROUND OF THE INVENTION

1. Field of the Invention

This invention relates to a releasable fastening construction, and more particularly, to a releasable fastening construction which is adapted to releasably fasten together both ends of an article, for example, such as personal ornaments including a necklace, a bracelet and the like.

2. Description of the Prior Art

A typical releasable fastening construction of such type which has been conventionally used to detachably or releasably fasten both ends of an article generally utilizes detachable fixing means such as the threaded engagement between a male screw and a female screw, the engagement of a ring with a hook, the fitting of a projection in a cutout, the connection by a magnet, or the like.

However, the conventional releasable fastening construction fails to concurrently accomplish both improved operationability and reliable fastening function. More particularly, the threaded engagement between male and female screws and the engagement between a ring and a hook provide the effective fastening between both ends of an article but is highly troublesome to carry out the fastening or releasing operation. The fitting of a projection in a cutout and the connection by a magnet allows the fastening or releasing operation to be readily carried out but fails to ensure the positive or reliable fastening.

Accordingly, it is highly desirable to develop a releasable fastening construction which is capable of not only readily accomplishing the fastening and releasing of both ends of an article without requiring any troublesome operation but ensuring the positive or reliable fastening.

SUMMARY OF THE INVENTION

Generally speaking, in accordance with the present invention, a releasable fastening construction for releasably fastening together both ends of an article is provided which comprises a first connector opened at the inner end thereof and closed the outer end thereof so as to define a blind hole therein, the first connector being connected at the outer end thereof to one end of the article; a second connector comprising a bar-like connector body which is adapted to be inserted at the inner end side thereof into the blind hole of the first connector, the second connector being connected at the outer end thereof to the other end of the article; at least one projection provided on one of the first and second connectors; at least one guide means of a substantially L-shape provided at the other of the first and second connectors, the guide means being adapted to permit the projection to be fitted therein to guide the projection therethrough when the bar-like connector body of the second connector is insertedly fitted in the blind hole and having projection holding means provided at the terminal end portion thereof; and magnets respectively arranged at the closed end of the blind hole and at the inner end of the bar-like connector body in a manner to be opposite to each other when said bar-like connector body is fitted in the blind hole and so as to repel each other.

In accordance with the present invention, there is also provided a releasable fastening construction for releasably fastening together both ends of an article comprising a first connector comprising a cylindrical connector body opened at the inner end thereof and closed at the outer end thereof so as to define a blind hole of a circular shape in vertical section therein and a first connecting member of a plate-like shape mounted on the outer end of the connector body so as to outward extend therefrom, the first connecting member serving to connect the first connector to one end of the article; a second connector comprising a round bar-like connector body which is adapted to be inserted at the inner end side thereof into the blind hole of the first connector, a second connecting member of a plate-like shape mounted on the outer end of the round bar-like connector body so as to outward extend therefrom and a flange provided between the round bar-like connector body and the second connecting member and having substantially the same diameter as the outer diameter of the cylindrical connector body of the first connector, the second connecting member serving to connect the second connector therethrough to the other end of the article; a projection provided on the peripheral surface of the bar-like connector body of the second connector; a guide means comprising a cutout of a substantially L-shape formed at the peripheral surface of the connector body of the first connector, the guide means being adapted to permit the projection to be fitted therein to guide the projection therethrough when the round bar-like connector body of the second connector is insertedly fitted in the blind hole of the cylindrical connector body of the first connector and having projection holding means provided at the terminal end portion thereof; magnets respectively arranged at the closed end of the blind hole and at the inner end of the round bar-like connector body in a manner to be opposite to each other when the round bar-like connector is fitted in the blind hole and so as to repel each other; said cutout constituting the guide means comprising a longer portion outward extending from the inner open end of the cylindrical connector body of the first connector along the axial direction of the cylindrical connector body and a shorter portion perpendicularly extending from the longer portion; the projection holding means comprising a semi-circular recess provided toward the inner open end of the cylindrical connector body of the first connector to hold the projection therein due to the repulsive force between the magnets; the flange being adapted to be abutted against the inner open end of the cylindrical connector body to regulate the fitting of the round bar-like connector body of the second connector in the blind hole of the cylindrical connector body when the round bar-like connector body is inserted through the inner open end of the cylindrical connector body into the blind hole; the projection being positioned on the round bar-like connector body so as to be aligned with the longitudinal direction of the shorter portion of the guide means when the flange is abutted against the inner open end of the cylindrical connector body, so that the projection may be guided along the shorter portion of the guide means when the second connector is turned in relation to the first connector.

Accordingly, it is an object of the present invention to provide a releasable fastening construction for releasably fastening together both ends of an article which is capable of not only readily accomplishing the fastening and releasing operation but ensuring the positive and reliable fastening.

It is another object of the present invention to provide a releasable fastening construction for releasably fastening together both ends of an article which is capable of attaining the above-described objects with a simple structure.

It is a further object of the present invention to provide a releasable fastening construction for releasably fastening together both ends of an article which is reliable in both the operation and structure.

Still other objects and advantages of the present invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals indicate like or corresponding parts throughout, wherein.

DETAILED DESCRIPTION OF THE PREFERRED EMBODIMENT

Now, a releasable fastening construction for releasably fastening together both ends of an article according to the present invention will be described hereinafter with reference to the accompanying drawings.

A releasable fastening construction for releasably fastening together both ends of an article according to the present invention which is exemplified herein is adapted to releasably fasten together both ends of personal ornaments such as a necklace, a bracelet or the like.

Figure 1:
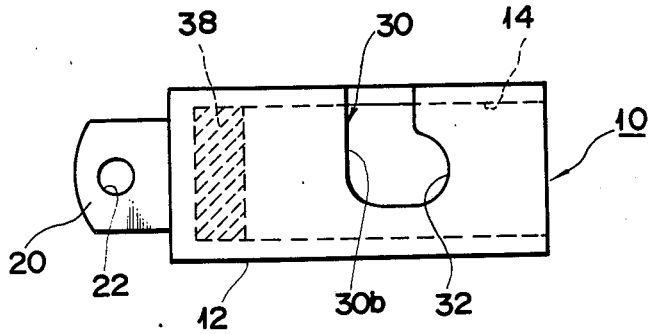
FIG. 1 is a side elevation view showing a first connector in an embodiment of a releasable fastening construction according to the present invention.
Figure 2:
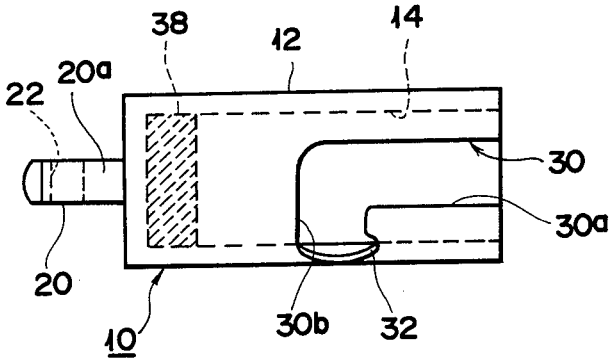
FIG. 2 is a plan view of the first connector shown in FIG. 1.
Figure 3:
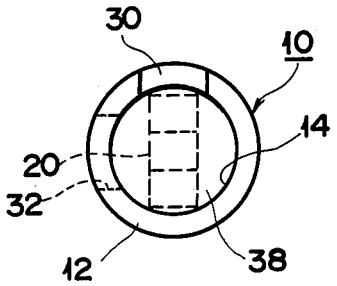
FIG. 3 is a front elevation view of the first connector shown in FIG. 1.
Figure 4:
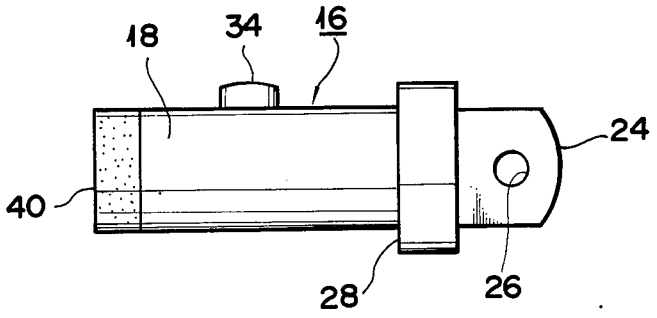
FIG. 4 is a side elevation view showing a second connector in the embodiment of a releasable fastening construction according to the present invention.
Figure 5:
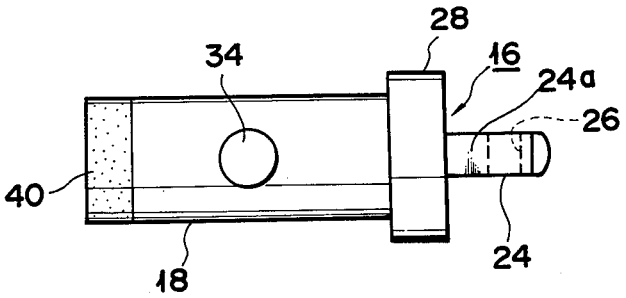
FIG. 5 is a plan view of the second connector shown in FIG. 4.
Figure 6:
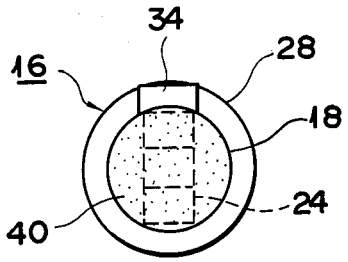
FIG. 6 is a front elevation view of the second connector shown in FIG. 4.

FIGS. 1 to 6 illustrate an embodiment of a releasable fastening construction according to the present invention. The embodiment illustrated is adapted to be applied to fasten both ends of personal ornaments together. The embodiment illustrated includes a first connector 10 constructed in such a manner as shown in FIGS. 1 to 3 which is adapted to be attached to one end of personal ornaments. The first connector 10 comprises a cylindrical connector body 12 opened at one end or the inner end portion thereof and closed at the other end or the outer end portion thereof to define a blind hole 14 therein. The releasable fastening construction of the illustrated embodiment also includes a second connector 16 constructed in such a manner as shown in FIGS. 4 to 6 which is adapted to be attached to the other end of the personal ornaments. The second connector 16 comprises a connector body 18 of a round bar-like shape adapted to be insertedly fitted in the blind hole 14 of the cylindrical connector body 12. The cylindrical connector body 12 and bar-like connector body 18 each are preferably formed of a suitable non-magnetic material, for example, such as a metallic material, a resinous material or the like.

Figure 12:
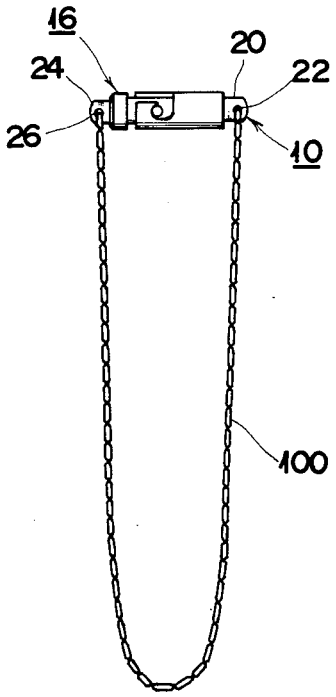
FIG. 12 is a general view showing the secure engagement or connection between the first connector connected to one end of a personal ornament and the second connector connected to the other end of the personal ornament.

The first connector 10 also includes a first connecting member 20 of a substantially plate-like shape which is integrally formed at outer end of the cylindrical connector body 12. The first connecting member 20 is formed with a through-hole 22, through which the first connector 10 is attached to one end of a personal ornament 100, as shown in FIG. 12. Correspondingly, the second connector 16 includes a second connecting member 24 of a substantially plate-like shape which is integrally provided at the outer end of the round bar-shaped connector body 18 and formed with a through-hole 26, with a flange 28 integrally provided between the round bar-shaped connector body 18 and the second connecting member 24. The second connecting member 24 acts to attach the second connector 16 via the through-hole 26 to the other end of the personal ornament 100. The flange 28 is preferably formed to have substantially the same diameter as the outer one of the cylindrical connector body 12, so that it may be abutted against the inner open end of the cylindrical connector body 12 to regulate the fitting of the round bar-shaped connector body 18 in the blind hole 14 of the cylindrical connector body 12 when the round bar-shaped connector body 18 is inserted through the inner open end of the cylindrical connector body 12 thereinto.

Figure 7:
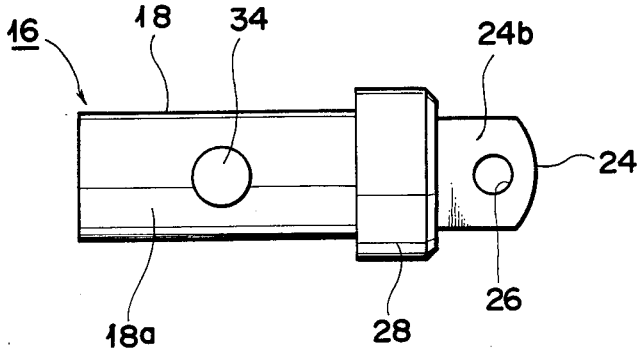
FIG. 7 is a side elevation view showing a modification of the second connector shown in FIGS. 4 to 6 wherein the position of a projection is varied.
Figure 8:
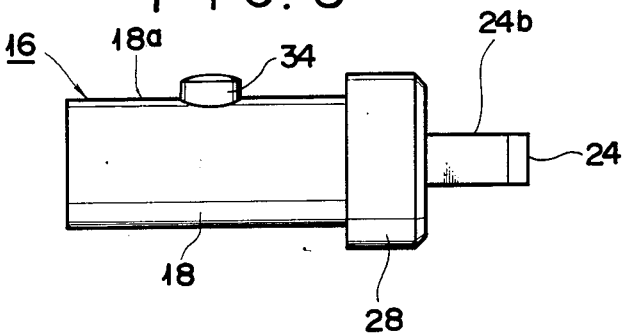
FIG. 8 is a plan view of the second connector shown in FIG. 7.
Figure 9:
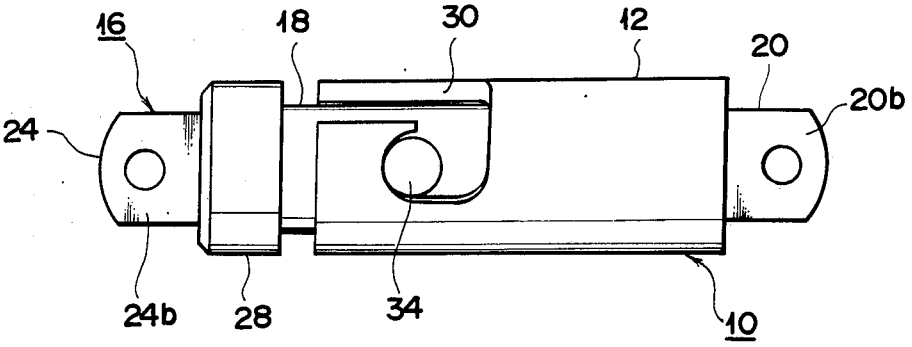
FIG. 9 is a diagram of assistance in explaining the connection between the first connector and the second connector shown in FIGS. 7 and 8.
Figure 10:
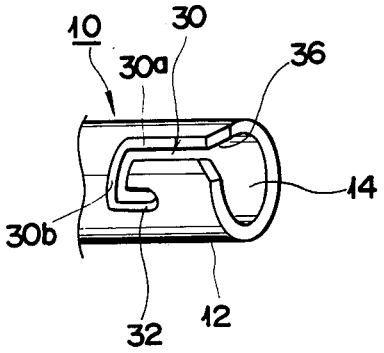
FIG. 10 is a fragmentary perspective view showing a modification of the first connector shown in FIGS. 1 to 3.

The first connector 10 is provided with a fitting guide designated by reference numeral 30, which, in the illustrated embodiment, comprises a cutout of a substantially L-shape formed at the cylindrical wall of the cylindrical connector body 12 so as to have a longer portion **30*a* outward extending along the longitudinal direction of the cylindrical connector body 12 from inner open end thereof and a shorter portion 30*b* extending from the longer portion in the direction perpendicular thereto. The terminal end of the shorter portion 30*b* of the L-shaped cutout 30 is formed on the side thereof facing the inner open end of the cylindrical connector body 12 with a recess 32 of a semi-circular shape. Correspondingly, the second connector 16 is provided with a pin-like projection 34 which radially extends from the cylindrical surface of the round bar-shaped connector body 18. The projection 34 is formed to have a shape sufficient to be fitted in the fitting guide 30 of the cylindrical connector body 12 and a size or diameter somewhat smaller than that of the semi-circular recess 32 of the shorter portion 30***b* of the fitting guide 30 so as to be received therein during the operation of insertedly fitting the round bar-shaped connector body 18 of the second connector 16 in the blind hole 14 of the first connector 10. Also, the projection 34 is preferably positioned on the round bar-shaped connector body 18 so as to be aligned with the direction of the shorter portion 30*b* of the fitting guide 30 when the flange 28 is abutted against the inner open end of the cylindrical connector body 12, so that the projection 34 may be guided along the shorter portion 30*b* of the fitting guide 30 when the second connector 16 is turned in relation to the first connector 10. In the illustrated embodiment, the insertion of the round bar-shaped connector body 18 of the second connector 16 into the blind hole 14 of the cylindrical connector body 12 and the fitting of the projection 34 into the guide 30 are carried out by holding the first and second connecting members 20 and 24 with fingers. In order to readily accomplish such operation, the illustrated embodiment, as shown in FIGS. 1 to 6, is constructed in a manner such that the longitudinal direction of the longer portion 30*a* of the L-shaped guide 30 is formed to be substantially aligned with the direction of thickness 20*a* of the first connecting member 20 of a plate-like shape and correspondingly the projection 34 is arranged to be substantially aligned with the direction of thickness 24*a* of the second connecting member 24 to facilitate the fitting therebetween. Alternatively, in the embodiment, the projection 34 may be positioned on the peripheral surface 18*a* of the round bar-shaped connector body 18 in a manner such that the cross section of the projection 34 is substantially parallel with one 24*b* of the flat side surfaces of the second connecting member 24, as shown in FIGS. 7 and 8. Such arrangement of the projection 34 effectively prevents tension due to the torsion of a chain of personal ornaments or the like from being applied to the personal ornaments and allows the ornaments to be nice to look at, because the flat side surfaces 20*b* and 24*b* of the first and second connecting members 20 and 24 are aligned with each other as shown in FIG. 9 when connecting the second connector 16 with the first connector 10 while rotating the second connector 16. Also, in order to more readily accomplish the operation of connecting the first and second connectors together, the longer portion 30*a* of the fitting guide or cutout 30 is preferably formed at the initial end thereof in a manner to be inward enlarged by rounding off the angles of the initial end, as indicated by reference numeral 36 in FIG. 10.

The first connector 10 also includes a magnet 38 mounted at the closed end or bottom of the blind hole 14 of the cylindrical connector body 12, and correspondingly the second connector 16 includes a magnet 40 mounted at the inner end of the round bar-shaped connector body 18. The magnets 38 and 40 are so arranged that the identical magnetic poles or N or S poles are opposite to each other to cause the magnets to repel each other, so that the cylindrical connector body 12 and round bar-shaped connector body 18 may be constantly forced to the direction opposite to each other due to the repulsive power of the magnets 38 and 40. The magnet 40 is preferably mounted in a manner to be embedded in the inner end of the round bar-shaped connector body 18. Such arrangement of the magnet 40 effectively prevents it from being damaged or broken.

Now, the manner of operation of the releasable fastening construction of the illustrated embodiment constructed in the manner as described above will be described hereinafter with reference to the accompanying drawings.

Figure 11:
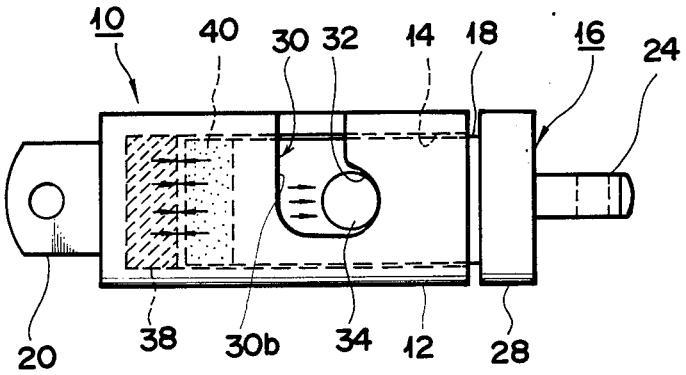
FIG. 11 is a diagram of assistance in explaining the secure engagement or connection between the first connector and the second connector in the releasable fastening construction shown in FIGS. 1 to 6.

First, the first and second connectors 10 and 16 are connected via the through-holes 22 and 26 of the first and second connecting members 20 and 24 to both ends of a personal ornament, respectively. Then, the projection 34 of the second connector 16 is fitted in the longer portion 30*a* of the L-shaped guide 30 and the second connector 16 is inserted into the first connector 10 to abut the flange 28 of the second connector 16 against the inner open end of the cylindrical connector body 12 while holding the connecting members 20 and 24 with fingers. Such operation can be readily carried out because the projection 34 and the longer portion 30*a* of the fitting guide 30, as described above, are positioned to align with the direction of thickness of the connecting members 20 and 24. Then, when the flange 28 is abutted against the inner open end of the cylindrical connector body 12, the second connector 16 is turned in relation to the first connector 10 to allow the projection 34 to be perpendicularly guided along the shorter portion 30*b* of the guide 30 and positioned in the semi-circular recess 32. Such relative rotation of the second connector 16 with respect to the first connector 10 is smoothly carried out without applying excessive load to the projection 34 because it takes place in a state that the flange 28 is slidedly contacted with the open end of the cylindrical connector body 12. Thereafter, when the fingers are released from the connecting members 20 and 24 of the first and second connectors 10 and 16, the round bar-shaped connector body 18 is forced in the direction away from the cylindrical connector body 12 due to the repulsion between the magnets 38 and 40 to securely engage the projection 34 with the semi-circular recess 32 of the terminal end of the fitting guide 30, as shown in FIG. 11. This results in the round bar-shaped connector body 18 being effectively prevented from being separated from the cylindrical connector body 12. Thus, it will be noted that the personal ornaments may be securely fastened together at both ends thereof. Also, such engagement between the semi-circular recess 32 of the terminal end of the fitting guide 30 and the projection 34 may be readily released by turning the round bar-shaped connector body 18 in relation to the cylindrical connector body 12 through the connecting members 20 and 24 in the opposite direction, thus, it will be also noted that the disengagement between the first connector 10 and the second connector 16 can be readily accomplished.

In the embodiment described above, the shorter portion 30*b* of the fitting guide 30 is formed to one side in FIG. 1. However, it is self-apparent that it may be formed on the opposite side of that shown in FIG. 1. Also, in the illustrated embodiment, a single fitting guide 30 and cooperating projection 34 are shown. However, two or more of such guides and projections may be used. Alternatively, two or more such fitting guides may be arranged as shown in FIG. 4 to more readily facilitate the fitting of corresonding projections 34. Also, in the illustrated embodiments, the fitting guide has been shown to comprise a cutout, however, it may comprise a concave groove formed on the inner surface of the cylindrical connector body 12. Alternatively, the releasable fastening may be constructed in a manner such that the fitting guide comprising such a concave groove is formed on the peripheral surface of the round bar-shaped connector body 18 and the projection 34 is provided on the inner surface of the cylindrical connector body 12. In such case, the concave groove is formed to have a longer portion outward extending from the inner end of the round bar-shaped connector body along the axial direction thereof and a shorter portion perpendicularly extending from the longer portion.

The present invention has been described with respect to the releasable fastening construction for personal ornaments. However, it is a matter of course that the present invention may be applied to various kinds of articles so far as the bar-like connector body is insertedly fitted in the blind hole of the first connector to fasten together both ends of an article. Accordingly, in the present invention, the bar member constituting the second connector is not limited to a round shape in section, and the member constituting the first connector and the blind hole each are not limited to a cylindrical shape.

Thus, it will be noted that the releasable fastening construction of the present invention can releasably fasten together both ends of an article with simple operation and carry out the reliable fastening.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A releasable fastening construction for releasably fastening together both ends of an article comprising:

a first connector opened at the inner end thereof and closed at the outer end thereof so as to define a blind hole therein, said first connector being connected at the outer end thereof to one end of said article;

a second connector comprising a bar-like connector body which is adapted to be inserted at the inner end side thereof into said blind hole of said first connector, said second connector being connected at the outer end thereof to the other end of said article;

at least one projection provided on one of said first and second connectors;

at least one guide means of a substantially L-shape provided at the other of said first and second connectors, said guide means being adapted to permit said projection to be fitted therein to guide said projection therethrough when said bar-like connector body of said second connector is insertedly fitted in said blind hole and having projection holding means provided at the terminal end portion thereof; and magnets respectively arranged at the closed end of said blind hole and at the inner end of said bar-like connector body in a manner to be opposite to each other when said bar-like connector body is fitted in said blind hole and so as to repel each other.

2. A releasable fastening construction as defined in claim 1, wherein said second connector further comprises a flange provided at the outer end of said bar-like connector body, said flange being adapted to be abutted against the inner open end of said first connector to regulate the fitting of said bar-like connector body into said blind hole of said first connector.

3. A releasable fastening construction as defined in claim 2, wherein said first and second connectors each are formed of a non-magnetic material.

4. A releasable fastening construction as defined in claim 1, wherein said first connector comprises a connector body; said blind hole being formed in said connector body;

said guide means comprising a cutout formed at the outer surface of said connector body, said cutout comprising a longer portion outward extending from the inner open end of said connector body along the axial direction of said connector body and a shorter portion perpendicularly extending from said longer portion;

said projection being arranged on the peripheral surface of said bar-like connector body of said second connector;

said projection holding means comprising a semicircular recess provided toward said open end of said connector body to hold said projection therein due to the repulsive force between said magnets.

5. A releasable fastening construction as defined in claim 4, wherein said first connector further comprises a first connecting member of a plate-like shape mounted at the outer end of said connector body, said first connecting member serving to connect said first connector to one end of the article; and said second connector further comprises a second connecting member of a plate-like shape mounted at the outer end of said bar-like connector body, said second connecting member serving to connect said second connector therethrough to the other end of the article.

6. A releasable fastening construction as defined in claim 5, wherein said guide means is arranged in a manner such that the longitudinal direction of the longer portion thereof is aligned with the direction of thickness of said first connecting member, and said projection is arranged to be aligned with the direction of thickness of said second connecting member.

7. A releasable fastening construction as defined in claim 6, wherein said first and second connecting members are formed with through-holes through which said first and second connectors are connected to said one and the other ends of the article, respectively.

8. A releasable fastening construction as defined in claim 7, wherein said blind hole of said first connector is cylindrical and said bar-like connector body of said second connector is round in vertical section.

9. A releasable fastening construction as defined in claim 8, wherein said connector body of said first connector comprises a cylindrical member.

10. A releasable fastening construction as defined in claim 9, wherein the initial end of said guide means is enlarged to facilitate the fitting of said projection in said guide.

11. A releasable fastening construction as defined in claim 10, wherein said first and second connectors each are formed of a non-magnetic material.

12. A releasable fastening construction as defined in any one of claims 4 to 11, wherein said second connector further comprises a flange provided between said bar-like connector body and said second connecting member, said flange being adapted to be abutted against the inner open end of said first connector to regulate the fitting of said bar-like connector body in said blind hole of said first connector when said bar-like connector body is inserted through said inner open end of said first connector into said blind hole; and said projection is positioned on said bar-like connector body so as to be aligned with the direction of said shorter portion of said guide means when said flange is abutted against said inner open end of said first connector body, so that said projection may be guided along said shorter porton of said guide means when said second connector is turned in relation to said first connector.

13. A releasable fastening construction as defined in claim 1, wherein said first connector comprises a connector body;

said blind hole being formed in said connector body;

said guide means comprising a concave groove formed on the inner surface of said connector body of said first connector, said concave groove comprising a longer portion outward extending from the inner open end of said connector body along the axial direction of said connector body and a shorter portion perpendicularly extending from said longer portion;

said projection being arranged on the peripheral surface of said bar-like connector body of said second connector;

said projection holding means comprising a semi-circular recess provided toward said inner open end of said connector body of said first connector to hold said projection therein due to the repulsive force between said magnets.

14. A releasable fastening construction as defined in claim 1, said first connector comprises a connector body;

said blind hole being formed in said connector body;

said guide means comprising a concave groove formed on the outer surface of said bar-like connector body of said second connector, said concave groove comprising a longer portion outward extending from the inner end of said bar-like connector body of said second connector along the axial direction of said bar-like connector body and a shorter portion perpendicularly extending from said longer portion;

said projection being arranged on the inner peripheral surface of said connector body of said first connector which defines said blind hole;

said projection holding means comprising a semi-circular recess provided toward said inner end of said bar-like connector body of said second connector to hold said projection therein due to the repulsive force of said magnets.

15. A releasable fastening construction as defined in claim 5, wherein said guide means is arranged in a manner such that the longitudinal direction of the longer portion thereof is aligned with the direction of thickness of said first connecting member, and said projection is arranged to be aligned with the direction of width of said second connecting member.

16. A releasable fastening construction for releasably fastening together both ends of an article comprising:

a first connector comprising a cylindrical connector body opened at the inner end thereof and closed at the outer end thereof so as to define a blind hole of a circular shape in vertical section therein and a first connecting member of a plate-like shape mounted on the outer end of said connector body so as to outward extend therefrom, said first connecting member serving to connect said first connector to one end of the article;

a second connector comprising a round bar-like connector body which is adapted to be inserted at the inner end side thereof into said blind hole of said first connector, a second connecting member of a plate-like shape mounted on the outer end of said round bar-like connector body so as to outward extend therefrom, and a flange provided between said round bar-like connector body and said second connecting member and having substantially the same diameter as the outer diameter of said cylindrical connector body, said second connecting member serving to connect said second connector therethrough to the other end of the article;

a projection provided on the peripheral surface of said round bar-like connector body of said second connector;

guide means comprising a cutout of a substantially L-shape formed at the peripheral surface of said connector body of said first connector, said guide means being adapted to permit said projection to be fitted therein to guide said projection therethrough when said round bar-like connector body of said second connector is insertedly fitted in said blind hole of said cylindrical connector body of said first connector and having projection holding means provided at the terminal end portion thereof;

magnets respectively arranged at the closed end of said blind hole and at the inner end of said round bar-like connector body and so as to repel each other;

said cutout constituting said guide means comprising a longer portion outward extending from the inner open end of said cylindrical connector body of said first connector along the axial direction of said cylindrical connector body and a shorter portion perpendicularly extending from said longer portion;

said projection holding means comprising a semi-circular recess provided toward said inner open end of said cylindrical connector body of said first connector to hold said projection therein due to the repulsive force between said magnets;

said flange being adapted to be abutted against the inner open end of said cylindrical connector body to regulate the fitting of said round bar-like connector body in said blind hole of said cylindrical connector body when said round bar-like connector body is inserted through said inner open end of said cylindrical connector body into said blind hole;

said projection being positioned on said round bar-like connector body so as to be aligned with the longitudinal direction of said shorter portion of said guide means when said flange is abutted against said inner open end of said cylindrical connector body, so that said projection may be guided along said shorter portion of said guide means when said second connector is turned in relation to said first connector.

* * * * *